US005103144A

United States Patent [19]

Dunham

[11] Patent Number: 5,103,144

[45] Date of Patent: Apr. 7, 1992

[54] BRIGHTNESS CONTROL FOR FLAT PANEL DISPLAY

[75] Inventor: Peter C. Dunham, Framingham, Mass.

[73] Assignee: Raytheon Company, Lexington, Mass.

[21] Appl. No.: 590,870

[22] Filed: Oct. 1, 1990

[51] Int. Cl.[5] ..... H01J 29/70; H01J 29/72

[52] U.S. Cl. ..... 315/366; 313/336

[58] Field of Search ..... 315/366, 169.2, 169.3, 315/169.4; 313/306, 309, 336, 495, 496

[56] References Cited

U.S. PATENT DOCUMENTS

| | | | |
|---|---|---|---|
| 3,755,704 | 8/1973 | Spindt et al. | 313/309 |
| 3,935,500 | 1/1976 | Oess et al. | 313/495 |
| 4,857,799 | 8/1989 | Spindt et al. | 313/495 |
| 4,904,895 | 2/1990 | Tsukamoto et al. | 313/336 |
| 5,015,912 | 5/1991 | Spindt et al. | 313/495 |

*Primary Examiner*—Theodore M. Blum
*Attorney, Agent, or Firm*—Christopher L. Maginniss; Richard M. Sharkansky

[57] ABSTRACT

An apparatus is disposed for controlling the brightness of a matrix-addressed flat panel CRT display of a type having intersecting column and row conductors forming, respectively, the gate and cathode electrodes of a field electron emission array. The brightness control is effected by controlling both the duty cycle and the voltage applied to the drive lines of the intersecting conductors. A periodic staircase waveform having progressively increasing voltage steps is sequentially applied to the row conductors. The voltages at each of the steps are preferably selected to enable electron beam currents which provide brightness levels which are twice the brightness of the previous step. Binary-coded video brightness data are simultaneously applied to all of the column conductors. The combined voltages at the intersections of the selected conductors cause a sequence of electron emissions onto luminescing means which result in a corresponding sequence of illumination intervals. The human optic system integrates this illumination sequence into the selected brightness level. In addition, the overall brightness of the display is controlled by gating the waveforms on the conductors with a pulse train comprising a sequence of adjustable, uniform-width pulses.

18 Claims, 4 Drawing Sheets

BRIGHTNESS CONTROL FOR FLAT PANEL DISPLAY

BACKGROUND OF THE INVENTION

The present invention relates generally to matrix-addressed flat panel cathode-ray tube (CRT) displays utilizing field emission cathodes and, more particularly, to a circuit for providing improved brightness control of such a display.

Cathode-ray tubes are widely used in display monitors for computers, television sets, etc. to provide visual displays of information. This wide usage may be ascribed to the favorable quality of the display which is achievable with cathode-ray tubes, i.e., color, brightness, contrast, and resolution. One major feature of a CRT permitting these qualities to be achieved is the use of a luminescent phosphor coating on a transparent face. Conventional CRTs, however, have the disadvantage that they require significant physical depth, i.e., space behind the actual screen, making them large and cumbersome. There are a number of important applications in which this depth requirement is deleterious. For example, the depth available for many compact portable computer displays and operational displays precludes the use of CRTs. Thus, there has been significant interest in an effort to provide satisfactory so-called "flat panel displays" or "quasi flat panel displays" not having the depth requirement of a typical CRT, while having comparable or better display characteristics, e.g., brightness, resolution, versatility in display, power requirements, etc. These attempts, while producing flat panel displays that are useful for some applications have not produced a display that can compare to a conventional CRT.

A flat panel display arrangement is disclosed in U.S. Pat. No. 4,857,799, "Matrix-Addressed Flat Panel Display," issued Aug. 15, 1989, to Charles A. Spindt et al. This arrangement includes a matrix array of individually addressable light generating means of the cathodoluminescent type having cathodes combined with luminescing means of the CRT type which reacts to electron bombardment by emitting visible light. Each cathode is itself an array of thin film field emission cathodes on a backing plate, and the luminescing means is provided as a phosphor coating on a transparent face plate which is closely spaced to the cathodes.

The backing plate disclosed in the Spindt et al. patent includes a large number of vertical conductive stripes which are individually addressable. Each cathode includes a multiplicity of spaced-apart electron emitting tips which project upwardly from the vertical stripes on the backing plate toward the face plate. An electrically conductive gate electrode arrangement is positioned adjacent to the tips to generate and control the electron emission. The gate electrode arrangement comprises a large number of individually addressable, horizontal stripes which are orthogonal to the cathode stripes, and which include apertures through which emitted electrons may pass. The gate electrode stripes are common to a full row of pixels extending across the front face of the backing structure, electrically isolated from the arrangement of cathode stripes. The anode is a thin film of an electrically conductive transparent material, such as indium tin oxide, which covers the interior surface of the face plate.

The matrix array of cathodes is activated by addressing the orthogonally related cathodes and gates in a generally conventional matrix-addressing scheme. The appropriate cathodes of the display along a selected stripe, such as along one column, are energized while the remaining cathodes are not energized. Gates of a selected stripe orthogonal to the selected cathode stripe are also energized while the remaining gates are not energized, with the result that the cathodes and gates of a pixel at the intersection of the selected horizonal and vertical stripes will be simultaneously energized, emitting electrons so as to provide the desired pixel display.

The Spindt et al. patent teaches that it is preferable that an entire row of pixels be simultaneously energized, rather than energization of individual pixels. According to this scheme, sequential lines are energized to provide a display frame, as opposed to sequential energization of individual pixels in a raster scan manner. This extends the duty cycle for each panel in order to provide enhanced brightness.

The present invention relates to the control of the brightness at each pixel, which is a function of the intensity of electron beam current emitted from the corresponding cathode-gate arrangement. One technique, currently in use in matrix-addressed flat panel CRT displays, employs pulse width modulation to control the brightness at each display pixel. This technique divides the line period into a number of intervals, wherein the time durations of each of these intervals within a single period are related according to a binary progression. Thus, for a line period comprising four intervals having time durations of one, two, four and eight time units, it is possible to provide from zero to fifteen time units of illumination at each pixel within a line period. The integrating effect of the human optic system and the retentive qualities of the phosphors on the display screen combine to translate these different-length time durations of illumination into different levels of brightness intensities.

In the above-described type of matrix-addressed display, the row and column conductors possess resistance and capacitance, resulting in a time constant which limits the rate at which they can be switched on and off. Thus, the standard brightness technique control of pulse width modulation controlling the duty cycle of each display pixel is limited by the range of "on" pulse widths, typically to four binary-related time intervals (or four bits), thereby providing a maximum of 16 levels of brightness. The factors contributing to the range limitations include the speed of available integrated circuits, the panel conductor time constants, and the over-all timing necessary to produce a quality image, which is a function of panel size.

It has been observed, however, that sixteen levels of brightness is inadequate for many display applications, and fails to make advantageous use of current computer graphics systems such as the video graphics array (VGA) standard. Clearly, there is a need for a flat-panel display arrangement that provides eight or more bits of binary brightness control (such is needed to produce a high quality display image, particularly for color rendering), while using existing digital integrated circuits, and without requiring reduction of the time constants of the panel conductors.

SUMMARY OF THE INVENTION

It is therefore an object of the present invention to provide an improved flat panel cathode-ray tube.

It is an additional object of the present invention to provide a matrix-addressed, flat panel cathode-ray tube having an extended range of brightness control.

In accordance with the principles of the present invention, there is disclosed an apparatus for use in a flat panel display, the display comprising a backing structure having a planar surface including a first plurality of substantially parallel conductors disposed across the surface and a second plurality of substantially parallel conductors disposed across the surface. The conductors of the first plurality intersect the conductors of the second plurality, but are electrically isolated from them. The display further comprises means at each intersection of the first and second pluralities of conductors for emitting an electron beam current therefrom in response to a potential difference between the intersecting conductors. The disclosed apparatus is for controlling the electron beam current from the emitting means at each of the intersections. The apparatus comprises first source means for coupling a periodic signal individually to the first plurality of conductors, the periodic signal comprising a plurality of steps of different voltage levels. The apparatus additionally comprises second source means for coupling a brightness control signal to the second plurality of conductors, the brightness control signal being driven between a first reference potential and a second reference potential in response to a binary-coded, video input signal. The voltage difference between the voltage level steps of the periodic signal coupled individually to the first plurality of conductors and the second reference potential of the brightness control signal coupled to the second plurality of conductors is sufficient to generate an electron beam current from the emitting means at the intersection of the conductor of the first plurality coupled to the first source means and the conductor of the second plurality coupled to the second source means, the electron beam current varying in accordance with the voltage difference.

In accordance with a preferred embodiment of the present invention, the aforementioned apparatus is included in a flat panel display further comprising a face structure having a second planar surface adjacent the backing structure surface including means on the second surface responsive to electron beam current for providing luminescence.

Further in accordance with the principles of the present invention, means are provided for gating the binary-coded, video input signal at each step of the periodic signal with equal, adjustable-length pulses, to thereby control the overall brightness the display.

With this arrangement, the brightness of the individual pixels of a matrix addressed flat panel display may be controlled. An extended range of brightnesses is provided by controlling the gate-cathode voltage, while the overall brightness of the display is controlled by adjusting the duty cycle of the gate-cathode voltage pulse.

BRIEF DESCRIPTION OF THE DRAWINGS

Other features and advantages of the present invention will be more fully understood from the following detailed description of the preferred embodiment, the appended claims, and the accompanying drawings, in which:

DESCRIPTION OF THE PREFERRED EMBODIMENT

Figure 1:
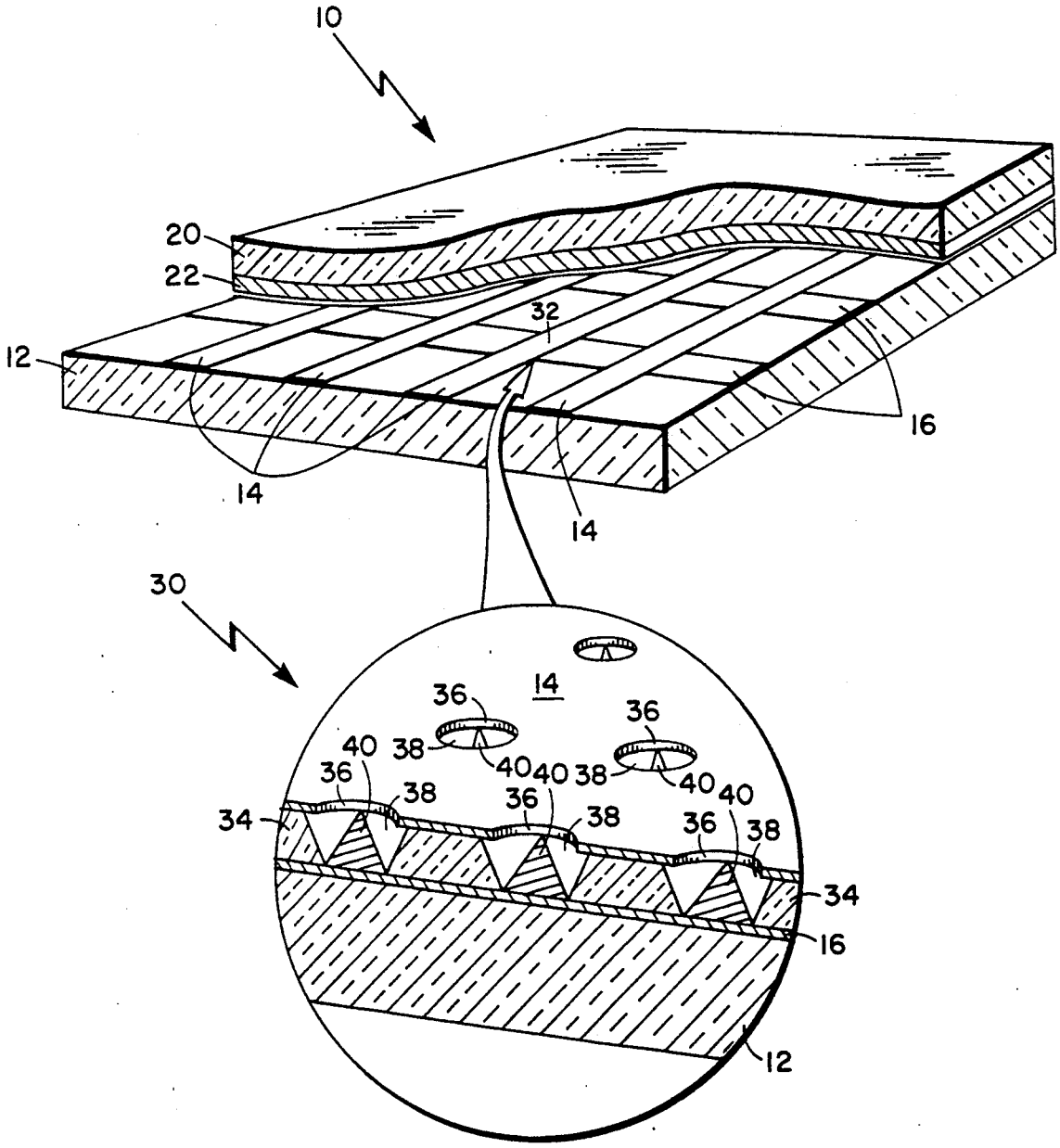
FIG. 1 is a partly cutaway drawing of a typical matrix-addressed flat panel display in which the brightness control apparatus of the present invention may be included.

Referring to FIG. 1, there is shown a partially cutaway view of a flat panel display 10 including a magnified view of a portion thereof. Flat panel display 10 includes a back glass plate 12 having a crisscrossed pattern of electrically-conductive columns 14, forming the cathode electrodes, and electrically-conductive rows 16, forming the gate electrodes. This pattern is overlaid by, but spaced from, a front glass plate 20 having a phosphor coating 22 on the inner surface thereof, comprising the anode electrode.

The portion shown magnified in FIG. 1 is a sectional view of an intersection 32 of a row and column, further depicting the individual elements of the gate and cathode electrodes of the electron emission apparatus 30 present at every such intersection 32. The electron emission apparatus 30 at intersection 32 comprises the conductive column 14 and the cor.ductive row 16, separated by an insulating layer 34. Further at each intersection 32 are a plurality of generally-circular apertures 36 in column layer 14, under which there are wells 38 formed in insulating layer 34, hollowed out down to the level of row layer 16.

Within each well 38 there is a conical metallic structure 40 which is electrically coupled to conductive row layer 16. This conical structure 40 is the part of the cathode electrode from which the field-induced electron emission takes place. The tip of each conical structure 40 is approximately at the upper level of column layer 14, and is generally centered within aperture 36.

Figure 2:
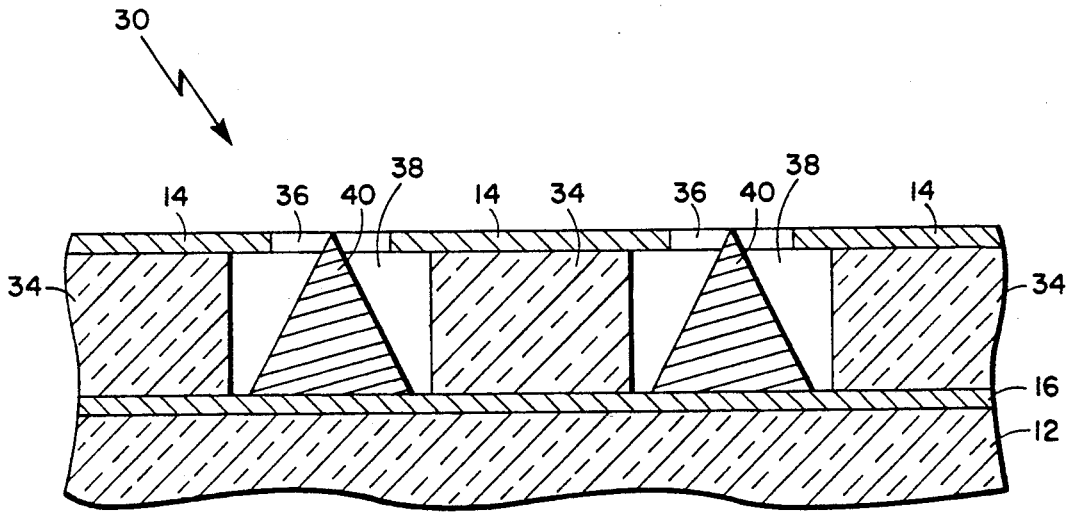
FIG. 2 is a sketch in cross section of an array of thin-film elements comprising an electron emission apparatus which may be of the type used in the flat panel display.

Referring to FIG. 2, there is a highly magnified sketch in cross section of a thin-film implementation of cathode and gate electrodes, which may be of the type comprising the electron emission apparatus at the row and column intersections in the present invention. Electron emission apparatus 30 includes an electrically insulating substrate 12, illustratively glass, onto which there is a conductive layer 16, illustratively a metal such as molybdenum, which serves as a common conductor for all of the cathodes 40. A layer 34 of electrically insulating material is affixed to conductive layer 16, and a second thin conductive layer 14, which forms the gate electrode, overlays layer 34. A plurality of apertures 36 in layer 14 extend through insulating layer 34 down to conductive layer 16, thereby forming a plurality of wells 38 in apparatus 30. Cathodes 40, situated within each of these wells 38, comprise generally conical structures fabricated of a conductive material, illustratively a metal such as molybdenum, which are all electrically connected via their contact with conductive layer 16.

It will be easily understood by one with knowledge in the art how to fabricate apparatus 30 as shown in FIG. 2, for example, using well-known photolithographic processes. Briefly, in a preferred process, a layer of molybdenum is deposited on glass substrate 12 and etched to form the row (cathode) conductors 16, which are typically 0.75 micron in thickness. An oxide film 34, illustratively silicon dioxide ($SiO_2$) about 0.75 micron thick, is vacuum deposited over the metalized substrate 12 to serve as a spacer and electrical insulator between the row conductors 16 and column conductors 14.

A second layer of molybdenum is deposited onto insulating oxide film 34 and etched to form the column (gate) conductors 14, which are typically also 0.75 micron in thickness. During this second etching process, an array of holes 36, each approximately one micron in diameter, is also etched through the gate electrode layer 14, and through the insulating oxide layer 34, extending down to the cathode electrode layer 16. The reactive ion etching process typically employed to form holes 36 in the oxide layer 34 produces a slight undercutting beneath gate electrode layer 14, leaving the edge of apertures 36 slightly overhanging, as illustrated in FIG. 2.

Cathodes 40 are all formed simultaneously in wells 38, typically by vacuum evaporation of molybdenum in a direction perpendicular to substrate 12. Prior to, and during this evaporation, chemically removable materials, such as aluminum, are vacuum deposited at near-grazing incidence, gradually closing holes 36 in gate electrodes 14 through which the evaporated molybdenum passes, to form a parting layer of decreasing diameter, eventually resulting in cone-shaped field-emitters 40 with the cone tips approximately in the plane of the top surface of gate electrodes 14. The cone shape and dimensions are very nearly identical among all cathodes 40, with the top radius about 30–40 nanometers.

In the final step of fabrication of electron emission apparatus 30, the material of the aluminum parting layer is dissolved and removed from around and within wells 38.

The present invention relates to an apparatus for controlling the brightness of a matrix-addressed flat panel CRT display of the type shown in FIGS. 1 and 2, and described in earlier paragraphs. The brightness control is effected by controlling both the duty cycle and the voltage applied to intersecting column and row drive lines. A waveform having progressively increasing voltage steps is applied to a selected conductor in one axis. The voltages at each of the steps are preferably selected to enable electron beam currents which provide brightness levels which are twice the brightness of the previous step. A binary-coded brightness control waveform is simultaneously applied to one or more selected conductors in the other axis. The combined voltages at the intersection(s) of these selected conductors cause a sequence of electron emissions which result in a corresponding sequence of illumination intervals. The human optic system integrates this illumination sequence into the selected brightness level. In addition, the overall brightness of the display is controlled by gating the waveform on the conductor at either axis with a pulse train comprising a sequence of adjustable, uniform width pulses.

Figure 3:
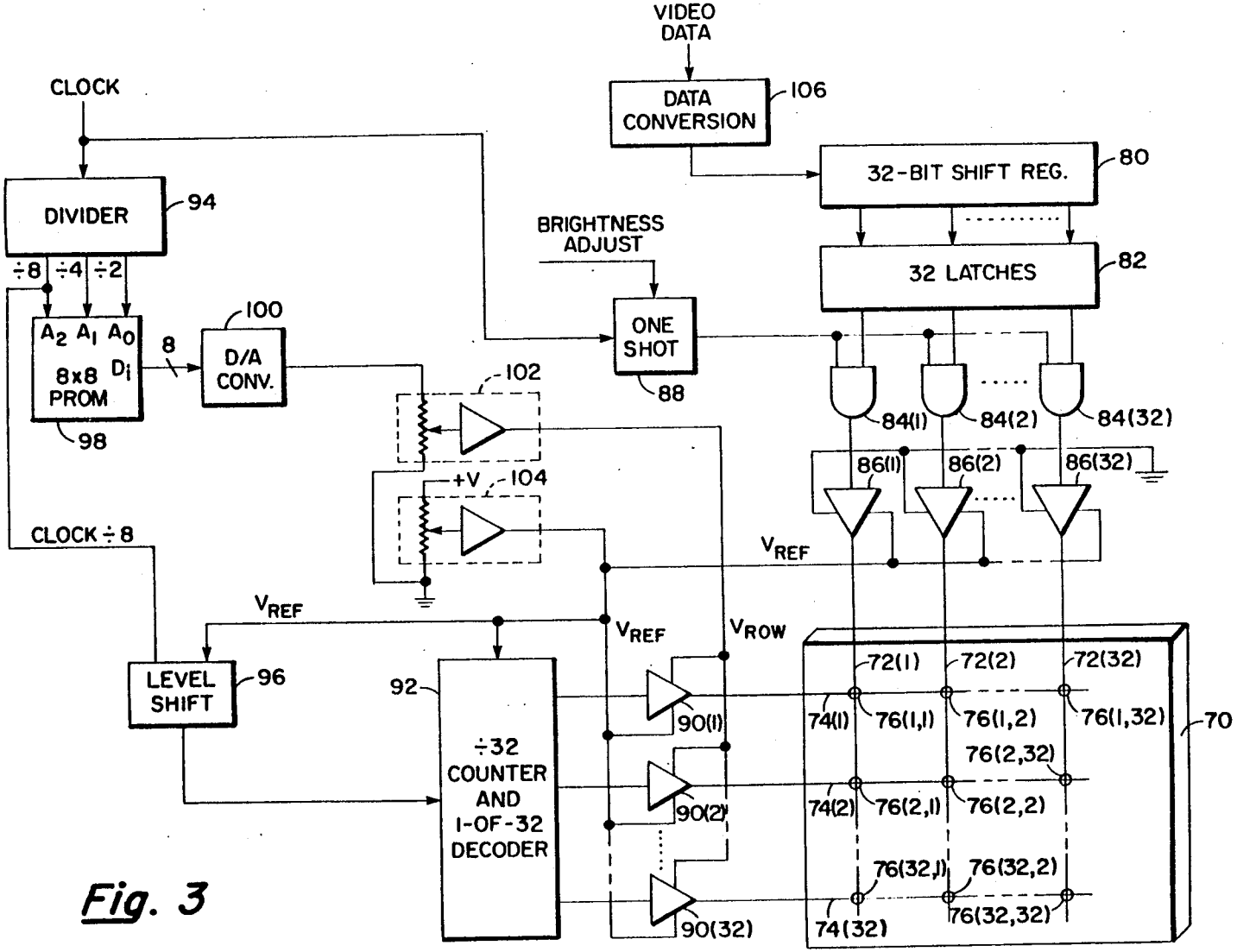
FIG. 3 is a block diagram of an embodiment of a brightness control circuit in accordance with the principles of the present invention.

Referring to FIG. 3, there is shown a block diagram of a brightness control circuit for use with a flat panel display in accordance with the principles of the present invention. Flat panel display 70 is shown having a multiplicity of column drive lines 72(1), 72(2), . . . , 72(32), referred to collectively as column drive lines 72, and a multiplicity of row drive lines 74(1), 74(2), . . . , 74(32), referred to collectively as row drive lines 74. The intersections of column drive lines 72 and row drive lines 74 occur at field electron emitters 76(1,1), 76(1,2) . . . , 76(1,32), 76(2,1), 76(2,2), . . . , 76(2,32) . . . , 76(32,1), 76(32,2), . . . , 76(32,32), referred to collectively as field electron emitters 76.

For the purpose of ease of illustration as well as understanding, it will be assumed that in this example the display panel 70 is a monochrome display having a 32×32 display matrix. Therefore, the disclosed embodiment will include 32 column drive lines 72 and 32 row drive lines 74. Nevertheless, it will be recognized that the principles taught herein are equally applicable to color displays, as well as to any size matrix, including the 640×400 VGA standard, or larger.

It will further be assumed that the video graphics system (not shown) which supplies the video drive signals to the brightness control apparatus of the present invention provides an 8-bit word of brightness data for each pixel of the display, thereby enabling 256 levels of display brightness at each pixel position.

The brightness control apparatus of FIG. 3 includes a 32-bit shift register 80 whose output signals are coupled to latch circuit 82. The 32 latched output signals are individually coupled to a first input terminal of AND gates 84(1), 84(2), . . . , 84(32), referred to collectively as AND gates 84. The AND gates 84 are individually coupled to drivers 86(1), 86(2), . . . , 86(32), referred to collectively as drivers 86. In the present example, drivers 86 are preferably of the totem-pole type, responsive to logic level input signals by applying one or the other of their two rail voltages to their output terminals. In the present example, the rail voltages on drivers 86 are zero volts and a reference voltage, $V_{REF}$, typically about 30 volts. Each driver 86(*i*) drives a corresponding column drive line 72(*i*) of panel display 70. An adjustable one shot circuit 88 drives the second input terminal of all AND gates 84, providing one adjustable-width pulse for each set of data clocked into latches 82. The widths of the pulses output from one shot circuit 88 are adjusted via the control designated BRIGHTNESS ADJUST.

The row drive lines 74 of panel display 70 are individually driven by totem-pole drivers 90(1), 90(2), . . . , 90(32), referred to collectively as drivers 90. Drivers 90 are responsive to the logic level voltages applied at their input terminals from decoder 92 for applying one or the other of their rail voltages to row drive lines 74. In the present example, the rail voltages coupled to drivers 90 are $V_{REF}$ and a voltage waveform $V_{ROW}$.

In the preferred embodiment, $V_{ROW}$ comprises a periodic staircase waveform of increasing voltages having, in this example, eight voltage levels, referred to as $V_0$, $V_1$, $V_2$, . . . , $V_7$. Successive levels are generated substantially in synchronism with the latching of data from shift register 80 into latches 82. A preferred method of selecting voltage levels $V_0$, $V_1$, $V_2$, . . . , $V_7$ is described in the paragraph relating to FIG. 4.

Counter/decoder 92 is responsive to a succession of voltage transitions at its input terminal by sequentially enabling its output terminals. In the practice of this circuit, counter/decoder 92 and drivers 90 operate such that the waveform $V_{ROW}$ is sequentially coupled to each of the row drive lines 74(*j*) while the remaining row drive lines sit at $V_{REF}$.

A timing signal, designated CLOCK in FIG. 3, corresponds in frequency to the rate at which video data is available at latches 82. Thus it is seen that CLOCK is the timing signal applied to an input terminal to one-shot circuit 88 to provide the gating signal for the data in latches 82.

The CLOCK signal is also coupled to a divider 94, illustratively a binary counter, which divides the frequency of the CLOCK signal by the number of bits of brightness control data for each display pixel. The most significant bit of the divider output signal, CLOCK÷8, is coupled through level shifter 96 to the input terminal of counter/decoder 92 to thereby sequentially select the row drive lines 74 at the rate of the brightness control data word. The three binary outputs of divider 94 are all coupled as input address lines to programmable read-only memory (PROM) 98.

PROM 98 includes eight stored words which are digital representations of eight predetermined voltage levels. In the present example, each of these memory words is eight bits in length, providing sufficient precision for the applications of the present invention. These eight data bits from PROM 98 are applied to digital-to-analog (D/A) converter 100 which produces, at its output terminal, the corresponding predetermined voltage levels.

The output signal from D/A converter 100 is coupled to adjustable voltage driver 102 whose output provides the $V_{ROW}$ signal to one rail of row drivers 90. A similar adjustable voltage driver 104, coupled to a voltage source, provides the $V_{REF}$ voltage to rails on both column drivers 86 and row drivers 90. Voltage drivers 102 and 104 are adjustable in order to properly select and maintain values of $V_{ROW}$ and $V_{REF}$, for the purpose of providing the desired levels of electron beam current.

Although the present invention is not meant to be limited to a system in which all of the pixels of a row are simultaneously energized, such an embodiment is preferred and is disclosed herein. As such, it is a requirement that shift register 80 be loaded with corresponding bits of all brightness data words of an entire row, i.e., all bit 0's of the 32 pixels of row 74(*j*), followed by all bit 1's of the 32 pixels of row 74(*j*), . . . , followed by all bit 7's of the 32 pixels of row 74(*j*), followed by all bit 0's of the 32 pixels of row 74(*j*+1), etc. In furtherance thereof, a data conversion circuit 106, not forming a part of this invention, is interposed between a conventional video data signal and shift register 80. Data converter 106 receives the typical 8-bit video data signal and outputs data according to the aforementioned scheme. Such data conversion devices are well known and include video random access memories (VRAMs).

In the preceding discussions, the circuitry associated with the column drive lines 72, viz., shift register 80, latches 82, AND gates 84 and drivers 86, and the circuitry associated with the row drive lines 74, viz., counter/decoder 92 and drivers 90, have been described with regard to their functions. However, it will be recognized by those knowledgeable in the area of video displays, that the described functions of each of the column and row circuits may be included in a single device. Such a device is, by way of illustration, Model HV53/HV54, sold by Supertex, Inc., of Sunnyvale, Calif.

It will be realized, however, that when a device such as that described in the preceding paragraph is used for the row drive circuitry of the present invention, wherein the reference potential ($V_{REF}$) is significantly different from the reference potential (0 volts) of the rest of the circuitry, a voltage level shifting circuit 96 is required to interface between the two voltage systems.

Figure 4:
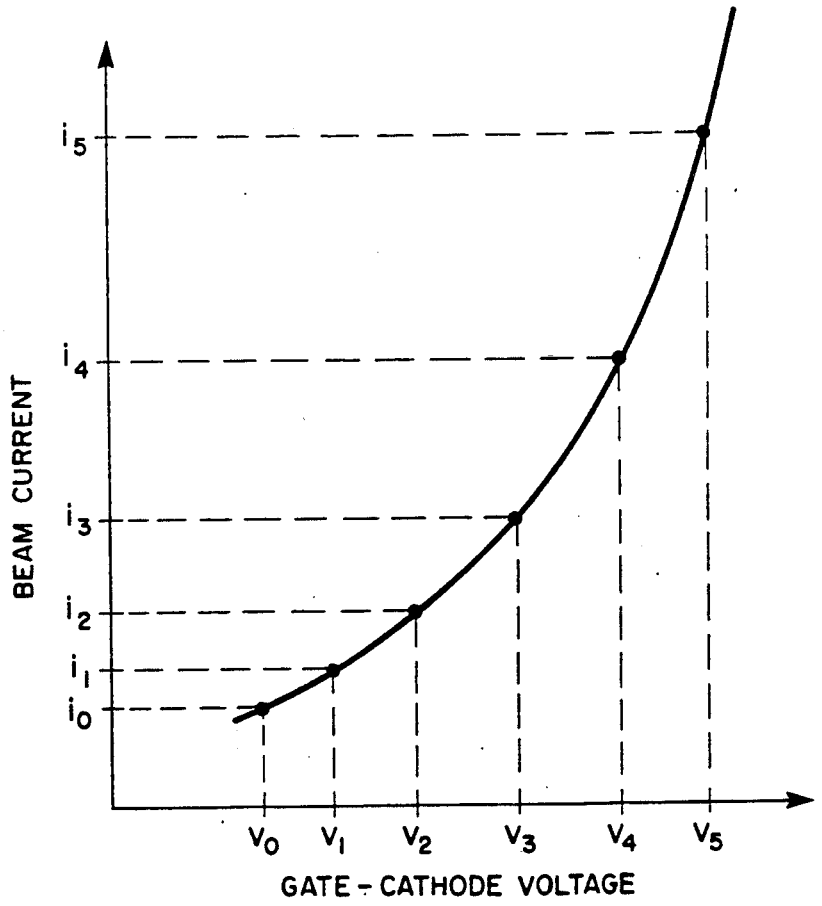
FIG. 4 is a plot of beam current vs. gate-cathode voltage useful in understanding the present invention.

Referring to FIG. 4, there is shown a plot of beam current for a range of gate-cathode voltages. Since the illustrative embodiment of the present invention provides sequential pulses of beam current which are related according to a binary progression, a first current level $i_0$ is selected, a second current level $i_1$ is selected which is twice the current level $i_0$, a third current level $i_2$ is selected which is twice the current level $i_1$, a fourth current level $i_3$ is selected which is twice the current level $i_2$, etc. For each selected current level $i_0$, $i_1$, $i_2$, . . . , the corresponding gate-cathode voltage $V_0$, $V_1$, $V_2$, . . . , which generates this beam current is noted. In the present example, for a sequence of eight voltage steps within each display period, the eight values of gate-cathode voltage comprise a substantially linearly range between 30 and 50 volts for beam currents of 1, 2, 4, 8, 16, 32, 64 and 128 microamperes.

Figure 5:
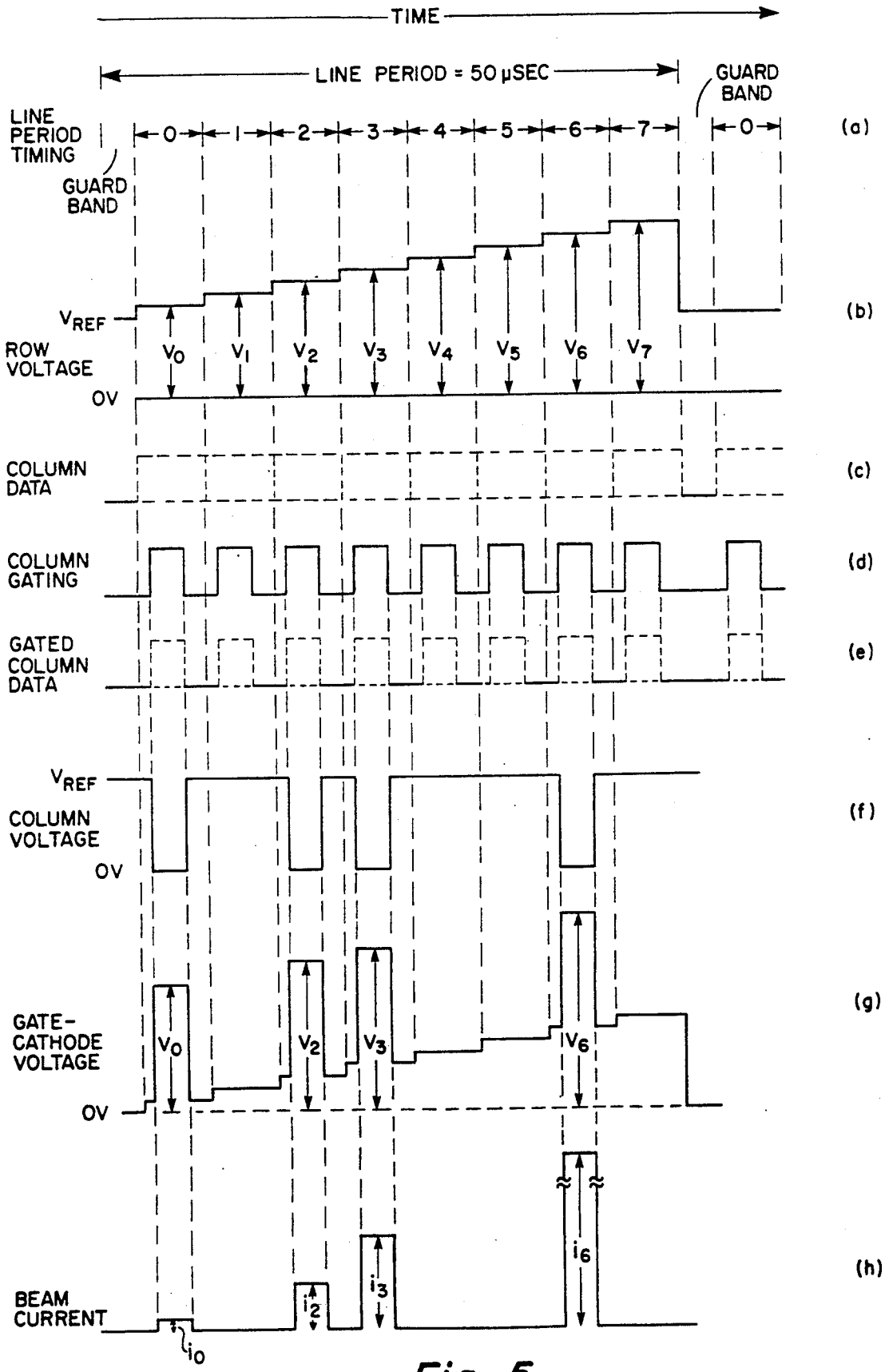
FIG. 5 is a set of timing diagrams useful in understanding the operation of the brightness control circuit of FIG. 3.

Referring to FIG. 5, there is shown an illustrative example comprising a series of plots, related on the time axis, which are useful in understanding the operation of the brightness control circuit of the present invention. Plot (a) illustrates a line period of 50 μsec., which is divided into eight equal segments of 6 μsec. each, and a guard band of 2 μsec. The eight segments of the line period are denoted segment 0, segment 1, . . . , segment 7, corresponding to the eight bits of brightness control data for each display pixel.

Plot (b) of FIG. 5 illustrates the voltage waveform which is sequentially applied to the individual row conductors. As is seen, the row conductors normally sit at a voltage $V_{REF}$; when line period of the particular row of interest is reached, the waveform of plot (b) is applied to the row conductor, stepping incrementally from $V_0$, to $V_7$ during the corresponding segments of the line period.

Plot (c) of FIG. 5 shows the timing of the eight bits of brightness data as appear serially at the ith output line of latch circuit 82 and applied as the column data at one input terminal of AND gate 84(*i*). Plot (d) illustrates the column gating signal, as may be generated by one shot circuit 88, and applied to the other input terminal of AND gate 84(*i*), for the purpose of providing overall brightness adjustment to the display, and for reducing switching transients. Plot (e) illustrates the timing of the output signal from AND gate 84(*l*).

Plots (f), (g) and (h) of FIG. 5 illustrate a particular example of brightness control data applied to one of the column conductors 72(*i*) via latch circuit 82, AND gates 84 and column drivers 86. In this example, the brightness control data has been arbitrarily selected as: 10110010, a shorthand representation for bit 0=1, bit 1=0, bit 2=1, bit 3=1, bit 4=0, bit 5=0, bit 6=1 and bit 7=0. As a result, the waveform of plot (f) is generated by the column driver 86 onto column conductor 72(*i*), wherein the voltage is driven down to 0 volts from $V_{REF}$ only during the gated periods of selected bits (bit=1). Column conductor 72(*i*) intersects a selected row conductor 74(*j*) having a voltage waveform as shown in plot (b) of FIG. 5. Since column conductor 72(*i*) includes the cathode electrode of the electron emitter at pixel 76(*i,j*), and row conductor 74(*j*) includes the gate electrode of the electron emitter at pixel 76(*i,j*), then the gate-cathode voltage waveform at the selected intersection will be shown in plot (g). As will be recalled from the discussion in regard to FIG. 4, voltages $V_0$ through $V_7$ are selected to provide electron beam currents related according to a binary progression. Thus, the beam current waveform illustrated in plot (h) of FIG. 5 will be generated in response to the brightness control data of this example, i.e., individual pulses of $2^0=1$, $2^2=4$, $2^3=8$ and $2^6=64$ units of current.

It will be observed from the waveform of plot (g) that for each time segment t of a line period for which the brightness control data bit is zero, i.e., bit t=0, there is a measurable gate-cathode voltage, ranging from a minimum value of $(V_0-V_{REF})$ for bit 0 to a maximum value of $(V_7-V_{REF})$ for bit 7. Nevertheless, the maximum value of gate-cathode voltage for a brightness control data bit of zero, $(V_7-V_{REF})$ at time segment 7, is still sufficiently below the minimum value of gate-cathode voltage for a brightness control date bit of one, $V_0$ at time segment 0, that the beam current emitted as a result is insignificant when compared to $i_0$.

While the principles of the present invention have been demonstrated with particular regard to the illustrated structure of the figures, it will be recognized that various departures may be undertaken in the practice of the invention. The scope of this invention is not intended to be limited to the particular structure disclosed herein, but instead be gauged by the breadth of the claims which follows.

What is claimed is:

1. In a flat panel display comprising a backing structure having a planar surface including a first plurality of substantially parallel conductors disposed across said surface and a second plurality of substantially parallel conductors disposed across said surface, said conductors of said first plurality intersecting said conductors of said second plurality, but electrically isolated therefrom; and further comprising means at each intersection of said first and second pluralities of conductors for emitting an electron beam current therefrom in response to a potential difference between said intersecting conductors; an apparatus for controlling the electron beam current from said emitting means at each of said intersections, said apparatus comprising:

first source means for coupling a periodic signal individually to said first plurality of conductors, said periodic signal comprising a plurality of steps of different voltage levels; and second source means for coupling a brightness control signal to said second plurality of conductors, said brightness control signal being driven between a first reference potential and a second reference potential in response to a binary-coded, video input signal, wherein the voltage difference between the voltage level steps of said periodic signal coupled individually to said first plurality of conductors and said second reference potential of said brightness control signal coupled to said second plurality of conductors generates an electron beam current from the emitting means at the intersection of the conductor of said first plurality coupled to said first source means and the conductor of said second plurality coupled to said second source means, said electron beam current varying in accordance with said voltage difference.

2. The apparatus according to claim 1 wherein said first plurality of conductors comprise row conductors and said second plurality of conductors comprise column conductors, said row conductors being orthogonal to said column conductors.

3. The apparatus according to claim 1 wherein said second source means couples brightness control signals simultaneously to all of said second plurality of conductors, to thereby simultaneously enable generation of electron beam current from all of the emitting means along the conductor of said first plurality coupled to said first source means.

4. The apparatus according to claim 1 wherein said periodic signal has a staircase waveform of progressively increasing voltage steps.

5. The apparatus according to claim 4 wherein the voltages at each of said waveform steps are selected to provide successive levels of electron beam current which are related according to a binary progression.

6. The apparatus according to claim 1 wherein said first source means includes:

means for storing digital representations of each of said plurality of voltage level steps; and means responsive to said storing means for converting said digital representations into analog voltage levels.

7. The apparatus according to claim 6 wherein said storing means includes a programmable read-only memory (PROM).

8. The apparatus according to claim 1 further including means for adjusting the voltage levels of said steps of said periodic signal and said first reference potential relative to said second reference potential.

9. The apparatus according to claim 1 further including means for gating said binary-coded video input signal at each voltage level step of said periodic signal, said gating means including means for generating a signal having a waveform of equal, adjustable-length pulses.

10. A flat panel display comprising:

a backing structure having a first planar surface including a first plurality of substantially parallel conductors disposed across said surface and a second pluralities of substantially parallel conductors disposed across said surface, said conductors of said first plurality intersecting said conductors of said second plurality, but electrically isolated therefrom;

means at each intersection of said first and second pluralities of conductors for emitting an electron beam current therefrom in response to a potential difference between said intersecting conductors;

a face structure having a second planar surface adjacent said first surface including means on said second surface responsive to electron beam current for providing luminescence; and means for controlling the electron beam current from said emitting means at each of said intersections, said controlling means including:

first source means for coupling a periodic signal individually to said first plurality of conductors, said periodic signal comprising a plurality of steps of different voltage levels; and second source means for coupling a brightness control signal to said second plurality of conductors, said brightness control signal being driven between a first reference potential and a second reference potential in response to a binary-coded, video input signal, wherein the voltage difference between the voltage level steps of said periodic signal coupled individually to said first plurality of conductors and said second reference potential of said brightness control signal coupled to said second plurality of conductors is sufficient to generate an electron beam current from the emitting means at the intersection of the conductor of said first plurality coupled to said first source means and the conductor of said second plurality coupled to said second source means, said electron beam current varying in accordance with said voltage difference.

11. The flat panel display according to claim 10 wherein said first plurality of conductors comprise row conductors and said second plurality of conductors comprise column conductors, said row conductors being orthogonal to said column conductors.

12. The flat panel display according to claim 10 wherein said second source means couples brightness control signals simultaneously to all of said second plurality of conductors, to thereby simultaneously enable generation of electron beam current from all of the emitting means along the conductor of said first plurality coupled to said first source means.

13. The flat panel display according to claim 10 wherein said periodic signal has a staircase waveform of progressively increasing voltage steps.

14. The flat panel display according to claim 13 wherein the voltages at each of said waveform steps are selected to provide successive levels of electron beam current which are related according to a binary progression.

15. The flat panel display according to claim 10 wherein said first source means includes:

means for storing digital representations of each of said plurality of voltage level steps; and means responsive to said storing means for converting said digital representations into analog voltage levels.

16. The flat panel display according to claim 15 wherein said storing means includes a programmable read-only memory (PROM).

17. The flat panel display according to claim 10 further including means for adjusting the voltage levels of said steps of said periodic signal and said first reference potential relative to said second reference potential.

18. The flat panel display according to claim 10 further including means for gating said binary-coded, video input signal at each voltage level step of said periodic signal, said gating means including means for generating a signal having a waveform of equal, adjustable-length pulses.

* * * * *